US005755321A

United States Patent [19]

Wang

[11] Patent Number: 5,755,321

[45] Date of Patent: May 26, 1998

[54] DESKTOP WITH MOUNTED RECTANGULAR STRUCTURES

[76] Inventor: Shenn-Ming Simon Wang, 3C, No. 60, Sec. 2, Tun-Hwa S. Rd., Taipei, Taiwan

[21] Appl. No.: 348,335

[22] Filed: Dec. 2, 1994

Related U.S. Application Data

[63] Continuation-in-part of Ser. No. 58,279, May 4, 1993, abandoned.

[51] Int. Cl.[6] ..... B65D 85/28

[52] U.S. Cl. ..... 206/214; 206/371

[58] Field of Search ..... 312/107, 348.3; 206/214, 224, 371

[56] References Cited

U.S. PATENT DOCUMENTS

| | | | |
|---|---|---|---|
| 4,118,084 | 10/1978 | Sussman | 312/107 |
| 4,941,576 | 7/1990 | Sugarman et al. | 206/214 X |
| 4,953,696 | 9/1990 | Hwang et al. | 206/214 |
| 5,040,681 | 8/1991 | Grusin | 206/371 X |
| 5,163,549 | 11/1992 | Hayduchok | 206/214 |
| 5,224,594 | 7/1993 | Hou | 206/224 X |
| 5,265,735 | 11/1993 | Hassel et al. | 206/214 X |

FOREIGN PATENT DOCUMENTS

| | | | |
|---|---|---|---|
| 3148884 | 5/1983 | Germany | 206/214 |

*Primary Examiner*—B. Dayoan
*Attorney, Agent, or Firm*—Bucknam and Archer

[57] ABSTRACT

There is provided a stationary platform adapted to be positioned on a desk and having intersecting grooves formed on the top surface of the platform so that a plurality of blocks are formed. A plurality of structures are also provided having flanged rims or raised ribs on the bottom which are insertable into the platform grooves so that each structure is capable of bridging at least one raised block.

7 Claims, 6 Drawing Sheets

DESKTOP WITH MOUNTED RECTANGULAR STRUCTURES

This application is a Continuation-In-Part of U.S. Ser. No. 058,279 filed May 4, 1993, now abandoned.

FIELD OF THE INVENTION

This invention relates to a desk top suitable to hold supply items in an orderly fashion.

BACKGROUND OF THE INVENTION

As modern men become more affluent, they pay more attention to a quality life and the desire for high quality commodities, for instance, most stationary supply items on one's desk usually include a pencil cup, a stapler, a memo card holder, a scotch tape dispenser, a clip box, etc.

However, when these items are put on a desk simultaneously, they might be in a mess and the user might have difficulty reaching for a paper clip without turning over some other items on the desk. Therefore, a stationary platform that could hold many kinds of desktop supplies would be desirable to increase the working efficiency in the office. This platform could be arranged neatly to provide easy retrieval of the items needed by the user, without disturbing other items on the desk.

SUMMARY OF THE INVENTION

One object of the invention is to provide a stationary platform to be placed over a desk top. The platform has intersecting grooves carved thereon so that a plurality of blocks are formed. Further the platform is provided with rectangular structures which have flanged rims at the bottom. The rims are insertable into the grooves. Each rectangular structure is capable of bridging at least one raised block. The rectangular structure may be arranged freely as the user wishes.

Another object of this invention is to provide a stationary platform which has a hollow space between the top surface and the bottom surface to contain heavy filler, for instance sand, so that the platform is stable when a rectangular structure is used by a single hand without holding the attachment by another hand, and the whole set will not be easily over-turned.

Still another object of this invention is to provide a stationary platform to be placed over a desk top with rectangular structures so that various arrangement or decoration of space configuration is facilitated and the whole atmosphere in the office or room can be decorative and functional.

DETAILED DESCRIPTION OF A PREFERRED EMBODIMENT

The structure, function, features and objects of this invention will be described in more detail in the accompanying drawings.

Figure 1:
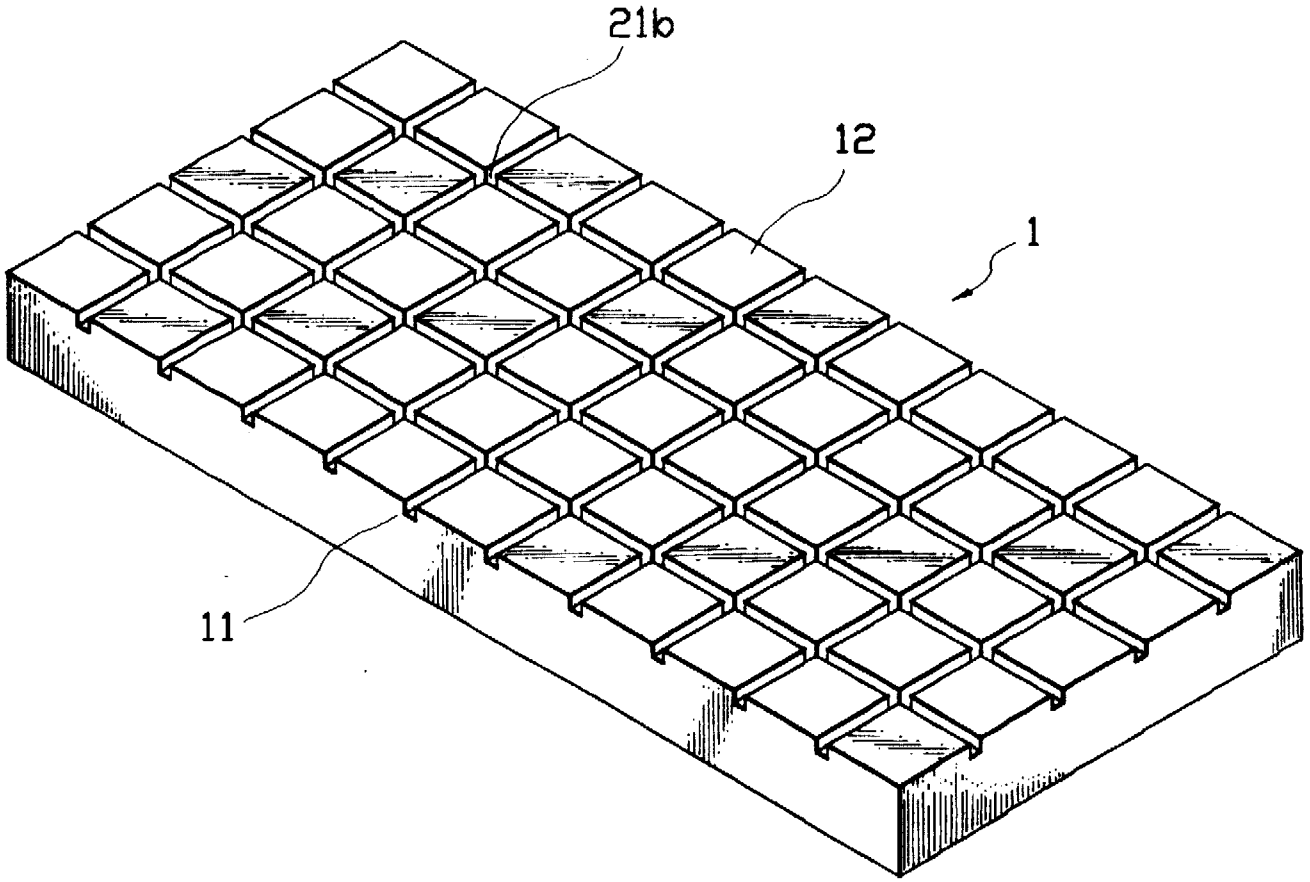
FIG. 1 is a perspective view of the stationary platform of the first embodiment with evenly spaced intersecting grooves and raised unit blocks.
Figure 2:
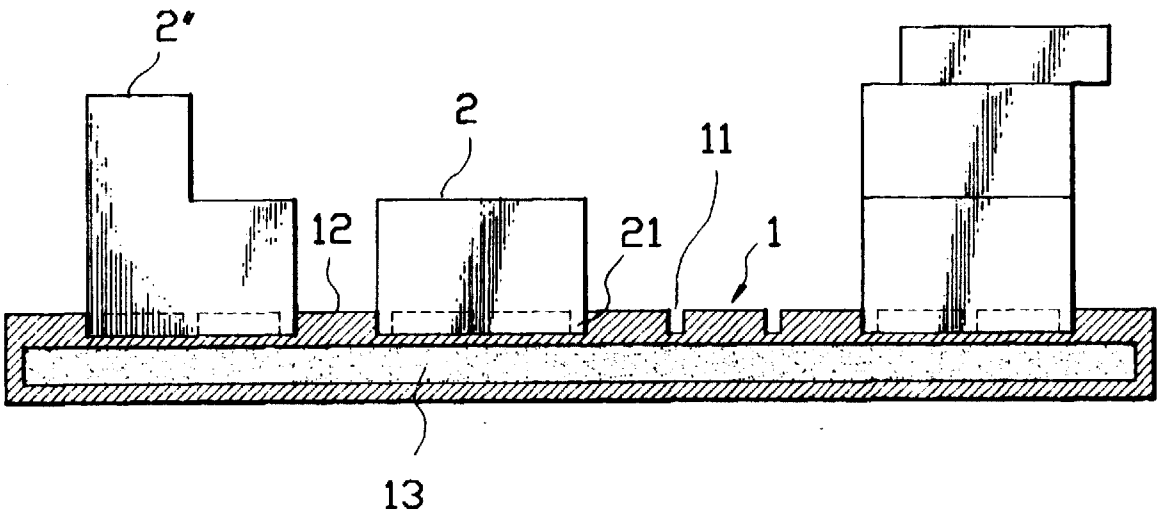
FIG. 2 is a cross-sectional view thereof with one inserted rectangular structure of the first embodiment and also shows a rectangular structure having a step configuration in place.

Now referring to FIGS. 1 and 2 a rectangular platform 1, which can be made integrally of plastic material, can be filled with a heavy filler 13 (as shown in FIG. 2) to increase the weight of platform 1, so that is will become more stable.

Cross-linking intersecting grooves 11 at equally distant intervals are carved on the platform, and the inserting grooves intersect at right angles, so that the entire platform surface is provided with grooves 11, and raised blocks 12 are formed on the platform.

Figure 3:
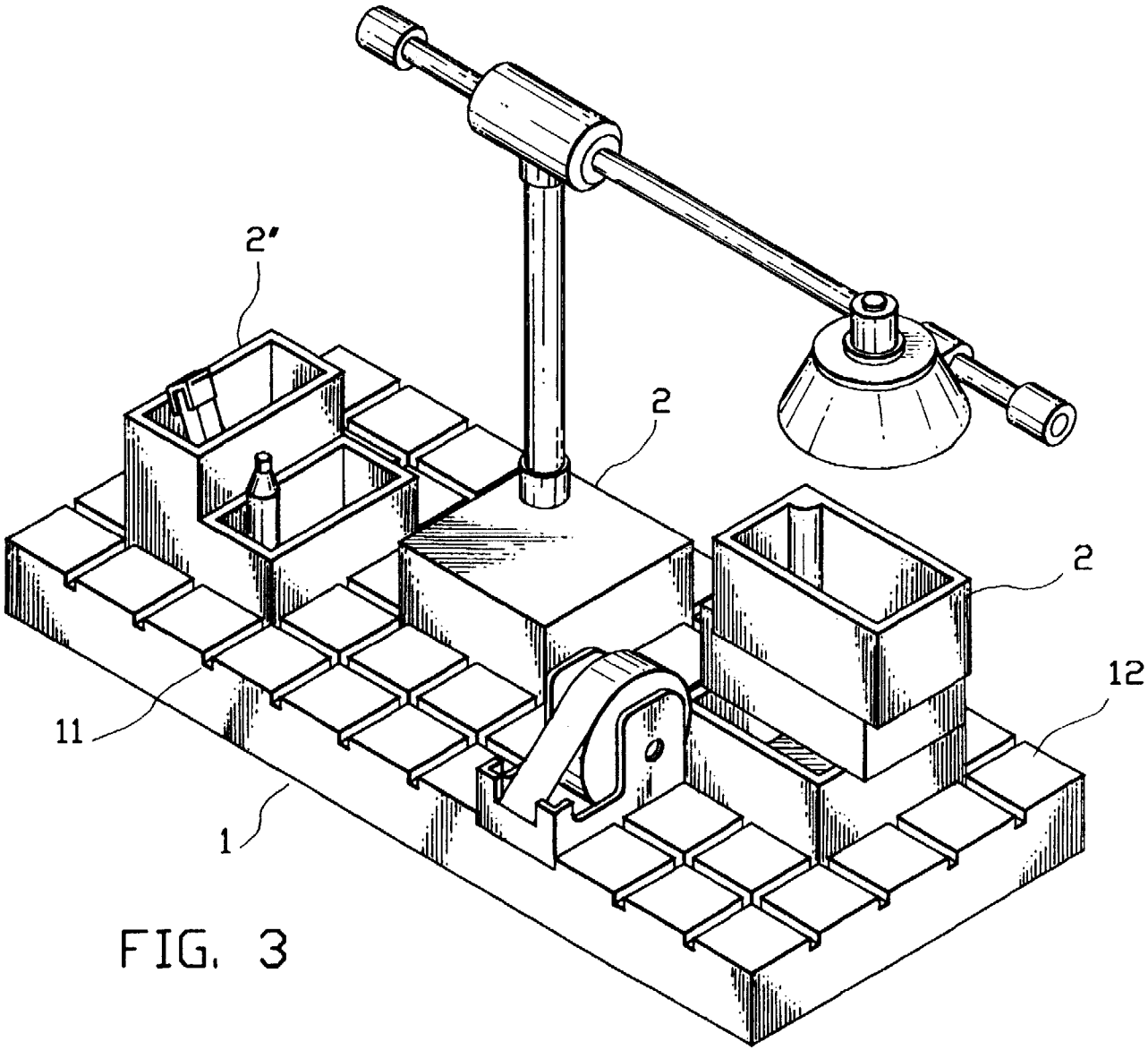
FIG. 3 is a perspective view of one of the embodiments thereof with various structures in place.

As shown in FIG. 2, rectangular structures 2 have at the bottom flanged rims 21. The rims are insertable into the grooves. The rectangular structures may bridge over at least one block 12 to become firmly mounted on the platform 1. FIGS. 2 and 3 also show the structures 2' having a step configuration.

FIG. 3 shows a tape dispenser and other supply items commonly used on a desk top. FIG. 3 also shows that rectangular structures of different size may be used and some of them may have a closed top.

Figure 4:
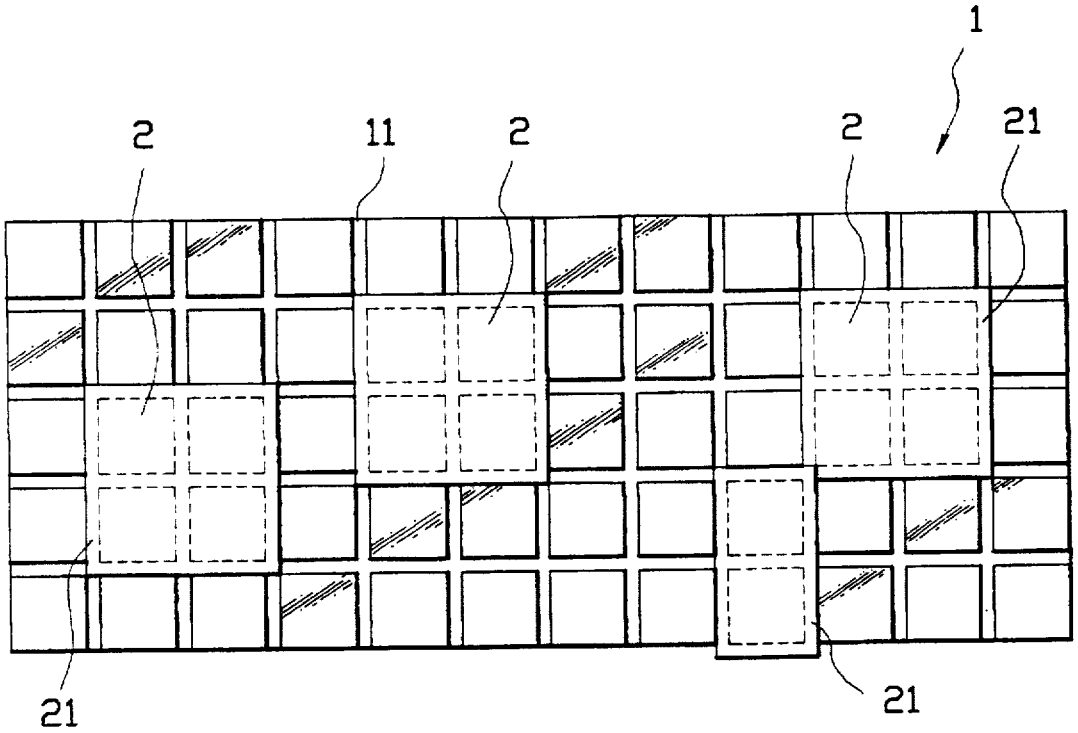
FIG. 4 is a top view thereof with various structures inserted in place.

Further as shown in FIGS. 3 and 4, since the intersected grooves are provided uniformly on the platform, various structures 2 can be positioned freely as the user wishes.

Figure 5:
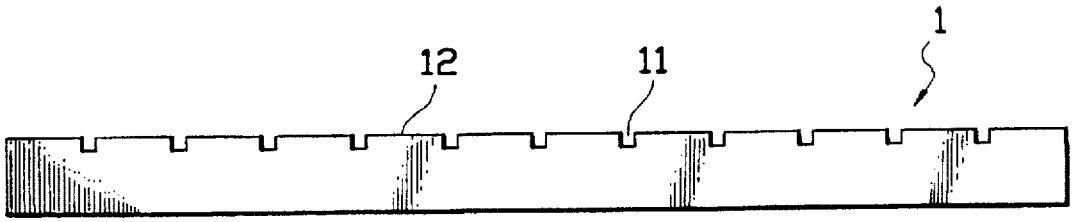
FIG. 5 is a side view thereof with a closer arrangement of grooves.

FIG. 5 shows that distance between the grooves may be adjusted to accommodate structures of different size.

Figure 6:
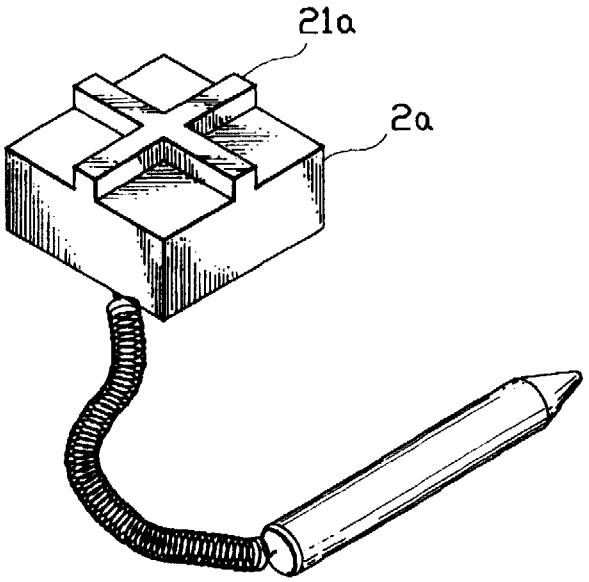
FIG. 6 is a perspective view of an inserted rectangular structure of the second embodiment with bottom side upward showing raised intersecting ribs insertable into the cross intersection grooves formed by the intersection grooves of platform as shown in FIG. 1.

FIG. 6 is a rectangular structure **2*a* of the second embodiment which is different from FIG. 2 by having at least raised intersecting ribs 21*a* formed at the bottom side, sized such that it is insertable into a cross intersection groove, such as 21*b*, formed by a horizontal and a vertical grooves. Then, when the raised intersecting ribs 21*a* at the bottom of the rectangular structure 2*a* is inserted into a cross-intersection groove in the platform 1 at a desired position, the rectangular structure 2*a*** can be stably fixed thereon.

Figure 7:
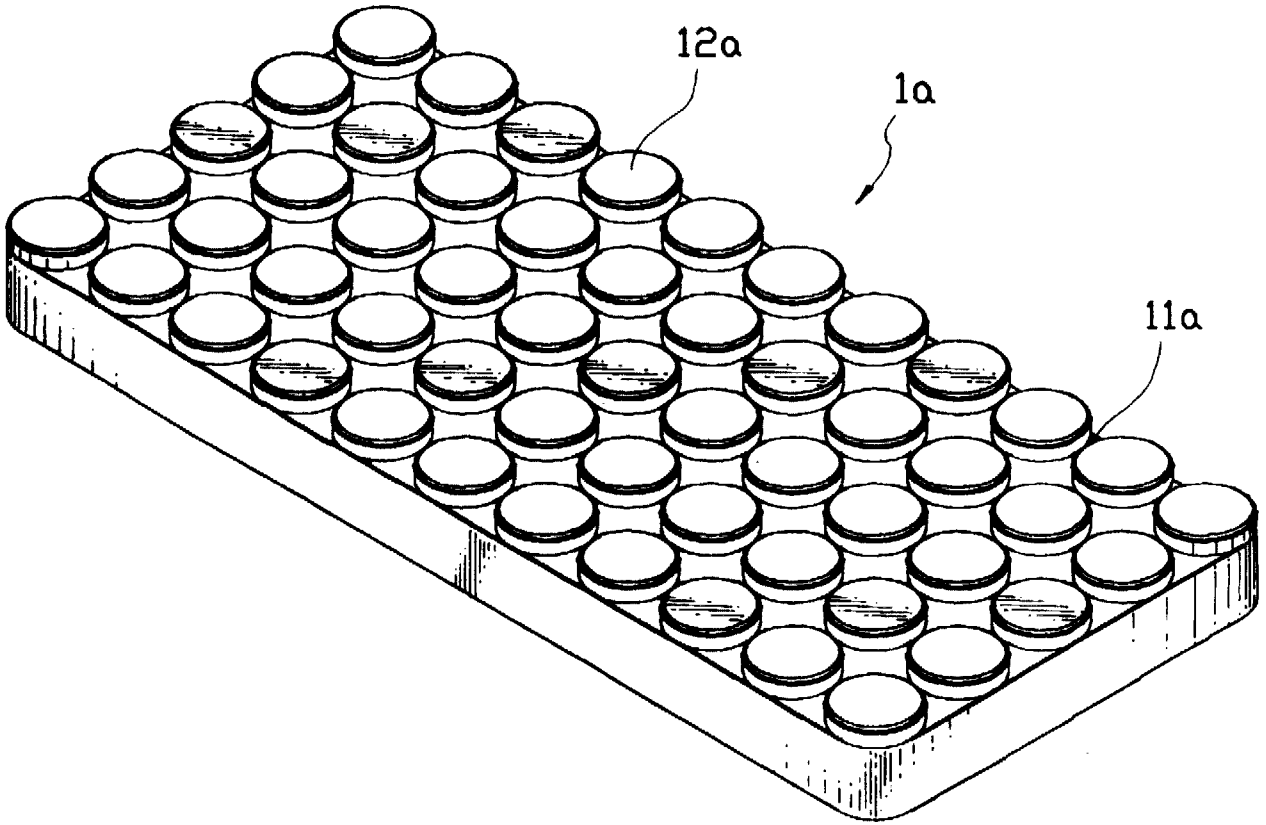
FIG. 7 is a perspective view of a platform structure of the second embodiment of the present invention with a plurality of evenly spaces short cylindrical rods.
Figure 8:
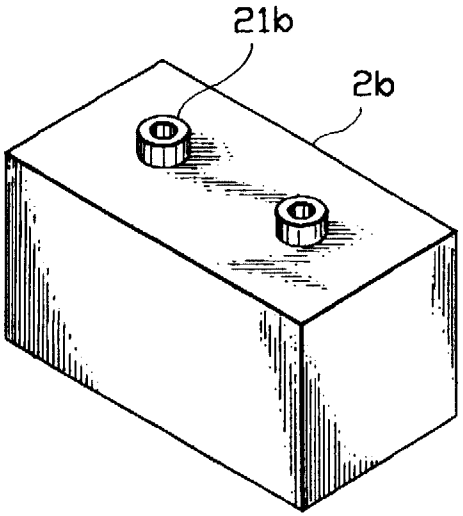
FIG. 8 is a perspective view of an inserted rectangular structure of the third embodiment with bottom side upward showing a short cylindrical tube insertable into the short cylindrical rods as shown in FIG. 7.

FIG. 7 is a platform la of the second embodiment of the present invention, which is different from FIG. 1 by forming on its edge face a plurality of evenly spaced short circular cylindrical rods **12*a*. In addition to this, as shown in FIG. 8, at least a short circular cylindrical tube 21*b* is formed on the bottom side of rectangular structures 2*b* and the tube 21*b* sized such that the tube 21*b* can be inserted into a corresponding cylindrical rod 12*a* to fix stably the rectangular structure 2*b* on the platform 1. In practice, if a rectangular structure 2*b* is larger in size, the number of short cylindrical tube 21*b* can be increased to enhance stability of the rectangular structure mounted on the platform 1**.

In FIG. 7, although the short circular cylindrical rods 12*a* being a representative in this description, they may also be formed such as the shapes of ellipse, triangle, or polygon; at the same time, the short cylindrical tubes 21*b* on the bottom edge face of the rectangular structures 2*b* can correspondingly be changed into ellipse, triangle or polygon too.

Figure 9:
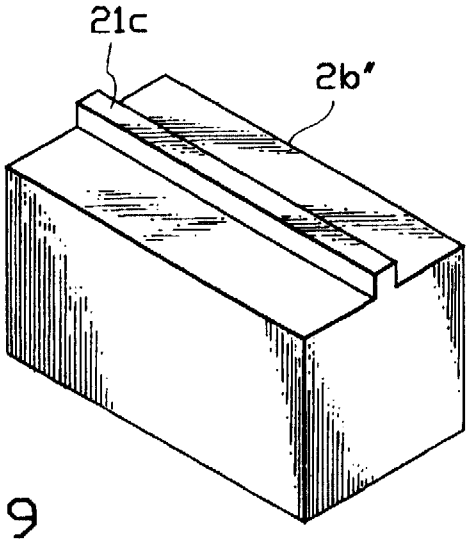
FIG. 9 is a perspective view of an inserted rectangular structure of the fourth embodiment with bottom side upward showing a raised rib insertable into the groove way as shown in FIG. 7.

Further, in FIG. 7, a groove way 11*a* is also formed between two rows of the projected short cylindrical rods 12*a;* accordingly on the bottom of the rectangular structure 2*b*" (FIG. 9), at least a raised rib 21*c*is formed to be able to insert into the corresponding groove way 11*a* so as to make the rectangular structure firmly fixed on the platform 1*a*.

It is understood by those skilled in the art that this invention should not be construed as restricted to the above-described embodiment and that various changes and modifications may be made in the invention without departing from the gist and scope thereof.

Other objects and advantages of the present invention will become apparent from the detailed description above accepted in conjunction with the appended claims.

What is claimed is:

1. The combination of a stationary platform (1) and a plurality of structures (2 and 2'), said stationary platform (1) having a bottom surface, a top surface having evenly spaced intersection grooves (11) thereon forming a plurality of raised blocks (12) on said top surface, and a hollow space between the top and bottom surfaces which contains a heavy material (13) for providing stability to said platform being placed on a desk top, said plurality of structures (2 and 2') having means for holding desktop supplies and having flanged rims (21) at the bottom thereof and protruding therefrom, sized such that they are insertable into said grooves, said flanged rims being spaced from one another such that each structure is capable of bridging at least one raised block.

2. The combination according to claim 1 wherein said plurality of structures are formed having different sizes.

3. The combination according to claim 1 wherein said structures are rectangular.

4. The combination according to claim 1 wherein at least one of said structures has a closed top.

5. The combination according to claim 1 which further includes structures having a raised rib on the bottom thereof insertable into said grooves.

6. The combination according to claim 1 wherein the spaced intersection grooves on the top surface of said stationary platform form a plurality of cross intersections and said combination further includes structures having intersecting raised ribs on the bottom thereof which are insertable into the cross intersections of the grooves on the top surface of said stationary platform.

7. The combination of a stationary platform and a plurality of structures, said stationary platform having a bottom surface, a top surface having evenly spaced intersection grooves thereon forming a plurality of raised blocks on said top surface, and a hollow space between the top and bottom surfaces which contains a heavy material for providing stability to said platform being placed on a desk top, said plurality of structures each having means for holding desktop supplies and having a flanged rim at the bottom thereof and protruding therefrom, sized so as to be insertable into said grooves.

* * * * *